United States Patent [19]

Schjeldahl

[11] 3,939,628

[45] Feb. 24, 1976

[54] BAG AND PACKAGE MAKING METHOD

[75] Inventor: Gilmore T. Schjeldahl, Minnetonka, Minn.

[73] Assignee: E. I. Du Pont de Nemours & Company, Wilmington, Del.

[22] Filed: July 26, 1974

[21] Appl. No.: 492,227

[52] U.S. Cl. ..... 53/29; 53/137; 53/183; 53/187; 53/373; 156/269; 156/290; 93/35 MW; 226/119

[51] Int. Cl.[2] ..... B65B 9/10; B65B 9/14; B65B 1/02

[58] Field of Search ..... 53/29, 37, 187, 40, 182, 53/41, 138 A, 137, 373, 180 R, 183, 197; 226/118, 119; 156/269, 290; 93/14, 17–20, 27, 35 MW

[56] References Cited

UNITED STATES PATENTS

| | | | |
|---|---|---|---|
| 2,490,940 | 12/1949 | Barker | 53/29 X |
| 2,978,852 | 4/1961 | Hopkins et al. | 53/373 X |
| 3,257,915 | 6/1966 | Cartier et al. | 93/35 MW X |
| 3,269,087 | 8/1966 | Cloud et al. | 53/29 X |
| 3,297,509 | 1/1967 | Mercer | 156/290 X |
| 3,389,533 | 6/1968 | Tipper et al. | 53/138 A X |
| 3,447,990 | 6/1969 | Fogg | 93/35 MW UX |
| 3,540,184 | 11/1970 | Ashton | 53/137 X |
| 3,710,541 | 1/1973 | Izumi | 53/29 |
| 3,726,060 | 4/1973 | McMillan | 53/138 A |
| 3,805,480 | 4/1974 | Cherio et al. | 53/197 X |

*Primary Examiner*—Travis S. McGehee
*Assistant Examiner*—Horace M. Culver

[57] ABSTRACT

A method is provided of making a bag including the steps of:

expanding tubular plastic netting in continuous rope form into an elongated sleeve with an open end;

positioning a first bottom closure strip across a first part of such sleeve;

positioning a second bottom closure strip across a second part of such sleeve and aligned with such first strip;

at least one of the strips having an adhesive coating on its inner surface and such strips being arranged to extend substantially from one edge of the sleeve to the other edge; and, adhering the first and second strips together through open meshes of such netting thereby to form a bag having a closed end and an open end.

In forming a closure for such a bag the method preferably includes the steps of:

expanding such tubular netting in the cross-machine direction;

gathering such expanded netting in rucked form;

expanding a portion of such rucked netting in the machine direction into an elongated sleeve; and applying closure members across such sleeve thereby forming a closure for the bag.

A method also is provided of making a package using a bag as described above including the further steps of:

severing the sleeve adjacent to the closure to make a bag;

inserting an article or articles into the open end of the bag; and closing the open end of the open end of such bag to form such package.

5 Claims, 16 Drawing Figures

BAG AND PACKAGE MAKING METHOD

BACKGROUND OF THE INVENTION

1. Field of the Invention

This invention is a bag and package making method and apparatus and, more particularly, is directed to a novel method of forming a closure across a sleeve formed by expanding a tubular plastic netting in rope form in a cross-machine direction; by rucking such expanded netting; and, by expanding a portion of such rucked netting in the machine direction.

2. Description of the Prior Art

Bag and package making apparatus and methods of this general type are old.

It is known, for example, as exemplified in U.S. Pat. No. 3,726,060 to McMillan, to package a product in a flexible tubular casing, which may be in the form of a plastic material, a tubular knitted material or other suitable flexible material and in which the casing is gathered or shirred onto a sleeve-like member and moved from the sleeve-like member along the outer surface of a support member and then inwardly of an opening therein whereby a continuous supply of tubular casing is provided for packaging items, such as hams, fed sequentially through such opening. A new supply of casing is required when the casing on the sleeve-like member runs out. Clips are provided for closing the casing adjacent both ends of the product to form the package.

U.S. Pat. No. 3,719,022 to Cherio et al. teaches a device for filling food stuff into netted containers which comprises a filler tube centrally positioned on a supporting frame, the tube being telescopically mounted and having thereabout a continuously fed and gathered netting which, as the ram of the tube extrudes the food stuff therefrom, disengages itself from the tube and becomes uniformly filled with the extrudate food stuff.

U.S. Pat. No. 3,380,220 to Jennings et al. discloses a tree packaging method including the steps of placing a supply of tubular material upon the exterior surface of a tubular element and intermittently drawing such material from this surface and into such tubular element for the purpose of enclosing a tree being passed therethrough. The tree movement draws the tubular material from the tubular element so that it will automatically encircle or enclose the tree. When the supply of tubular material on the tubular element is exhausted, the empty tubular element is moved to a loading station where a new supply of material is placed on it.

Other patents of interest are U.S. Pat. No. 231,270 to Case which shows a machine for rolling tubular fabrics, U.S. Pat. No. 3,257,915 to Cartier et al. which shows a bag forming machine, and U.S. Department of Agriculture bulletin ARS-S-18 of July 1973, entitled "Automatic Produce-Bagging Machine that uses Factory-Roll Polyethylene Net Tubing", which shows a machine that makes a package from tubular netting, such package having gathered and stabled top and bottom closures.

In the apparatus and methods described in these patents and bulletin, as in other apparatus and methods of the known prior art, the bag and package making operations are either not continuous, require additional steps or parts, or do not provide the total, practical, utility found in the bag and package making methods of this invention, as will become apparent.

SUMMARY OF THE INVENTION

The bag and package making apparatus of this invention is continuous in operation and is capable of making, in line, a package using a tubular plastic netting in rope form.

This rope of netting is expanded into an elongated sleeve and, as one step in making a bag, a closure is applied across such expanded sleeve. At the time the closure is applied the sleeve is relaxed, with no machine or cross-machine direction forces acting upon it. This is made possible, in part, by the provision of a rucked supply of expanded netting at a location prior to the closure station and the withdrawing of only a portion of this rucked supply to the closure station whereby the remaining rucked netting assures that no machine direction forces are placed upon the sleeve as the closure is applied. This is an important aspect of this invention.

A bag is made using the apparatus and method of this invention by severing the expanded sleeve after a closure has been provided, after which articles, such as oranges, are inserted into the open end of the bag to fill it. Then an open end is closed to form the package.

Such package is made continuously and in line on the package making apparatus. There is no need, for example, to stop the apparatus to provide additional rucked netting at an intermediate station because in the apparatus of this invention this rucked supply is continuously formed from a rope of the netting by appropriate means.

Further, by using the apparatus of this invention it is possible to close a sleeve formed of tubular netting by adhering strips to each other through the open mesh of the netting and to the netting itself, in forming a bag closure, for example, either top or bottom.

Other means also are provided to sever this sleeve with its closure to make a bag; to open the open end of this bag; to insert an article or articles into it; and to close such open end, all in line, in making an attractive package of great utility in the bag and package making arts.

DESCRIPTION OF THE PREFERRED EMBODIMENT

Figure 1:
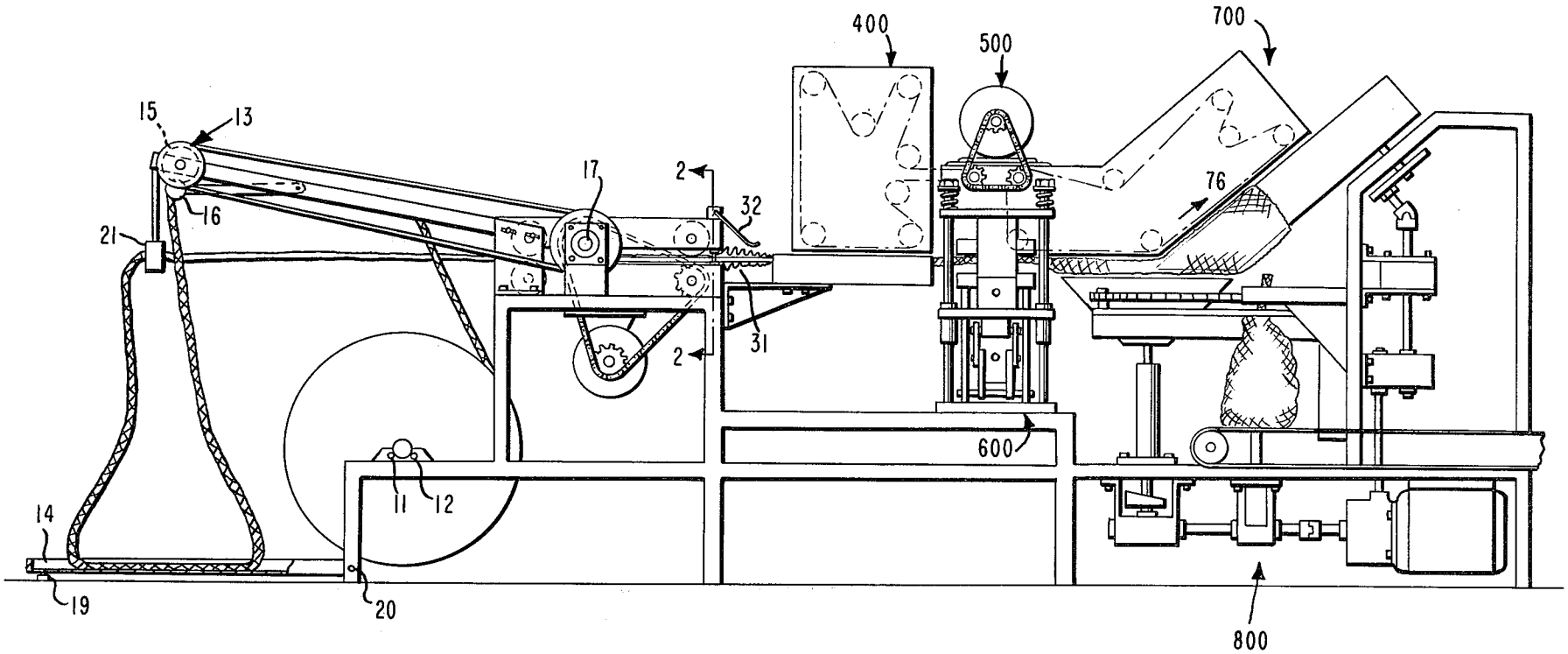
FIG. 1 is an elevational view of an apparatus of this invention showing one side thereof, with parts (such as parts of the closure applying station or means) omitted for clarity.

This invention is a bag and package making method and apparatus.

In its broadest sense, such invention is also a method of forming a closure for a bag made using plastic netting in continuous rope form unwound from a reel, in a continuous repetitive manner, and includes the steps of:

- expanding such netting into an elongated sleeve, and
- applying a flat elongated strip across such sleeve thereby forming a closure (either top or bottom) for such bag.

Preferably this method further includes the steps of:

- expanding such netting in the cross-machine direction;
- gathering such expanded netting in rucked form;
- expanding a portion of such rucked netting in the machine direction into an elongated sleeve; and
- applying closure members across such sleeve thereby forming the closure for such bag.

Preferably such closure members are adhered together through open meshes of such netting.

In making the bag, the expanded sleeve preferably is severed adjacent the closure thereby to make a bag having a closed end and an open end.

In making a package made using this type bag the method steps of this invention preferably include:

- expanding such netting into an elongated sleeve having an open end and substantially flat first and second sleeve parts, one atop the other;
- positioning a first strip across such sleeve and adjacent to the outer surface of such first sleeve part;
- positioning a second strip across such sleeve and adjacent to the outer surface of such second sleeve part and aligned with the first strip;
- at least one of such strips having an adhesive coating on its inner surface and such strips being positioned to extend substantially from one edge of such sleeve to the other edge;
- adhering such first and second strips together through open meshes of such sleeve thereby to form a bottom closure for such bag;
- severing such sleeve adjacent such bottom closure to make such bag;
- inserting articles into such open end of such bag; and
- closing such open end of such bag to form a package.

In other embodiments, this invention is an apparatus suitable for the practice of the bag, or sleeve, closure forming and bag and package making methods of this invention.

Briefly described, the apparatus for making bags includes:

- means for storing a supply of tubular plastic netting in continuous rope form;
- means for expanding such netting into an elongated sleeve;
- means for applying flat elongated strips across such sleeve to form a closed end, and
- means for severing part of such sleeve including such closed end from the remainder of such sleeve to form a bag having a closed end spaced from an open end.

In somewhat greater detail an apparatus for making a package made using such bags made using this tubular plastic netting comprises, in combination and operably connected together:

- means for storing a supply of such netting in continuous rope form;
- means for expanding the netting in the cross-machine direction;
- means for gathering this expanded netting in rucked form;
- means for expanding such rucked netting in the machine direction into an elongated sleeve having substantially flat first and second sleeve parts, one atop the other;
- means for positioning a first strip across the expanded sleeve and adjacent to the outer surface of the first sleeve part;
- means for positioning a second strip across the sleeve and adjacent to the outer surface of the second sleeve part and aligned with the first strip;
- at least one of the strips having an adhesive coating on its inner surface and such strips being positioned to extend substantially from one edge of the sleeve to the other edge;
- means for adhering the first and second strips together through open meshes of the sleeve thereby to form a bottom closure for the bag;
- means for severing the sleeve to make such bag having a bottom closure and an open end;
- means for inserting articles into the open end of such bag; and means for closing such open end of such bag to form the package.

The details of the parts and operation of this apparatus may be more clearly understood by reference to the drawing and to the following description thereof.

Figure 3:
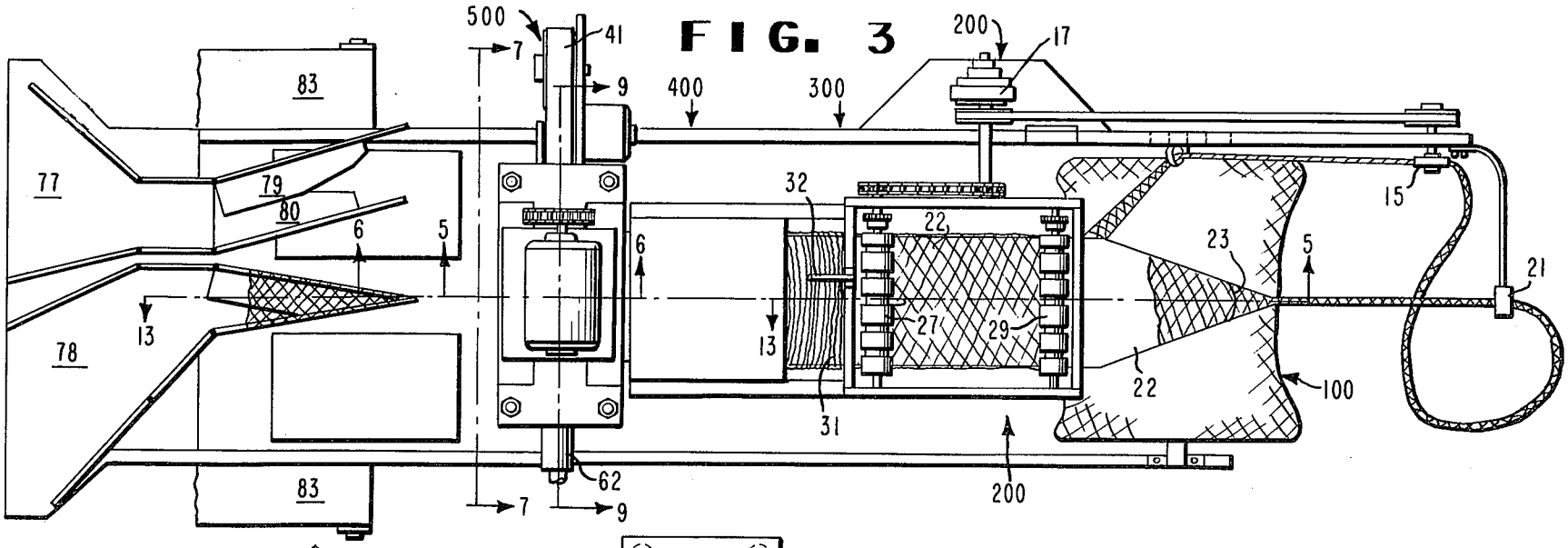
FIG. 3 is a plan view of the apparatus with parts broken away and others omitted for clarity.
Figure 4:
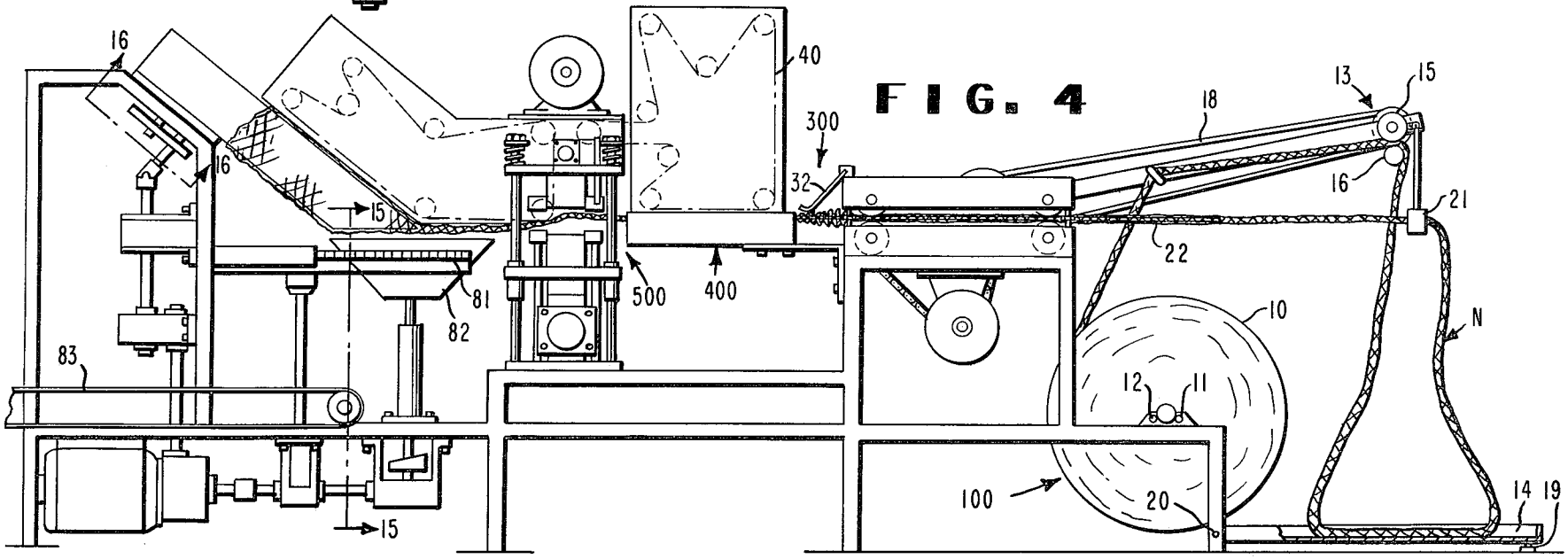
FIG. 4 is a partial elevational view showing the other side of the apparatus shown in FIG. 1.

As best seen in FIGS. 1, 3 and 4, the basic parts of such packaging making apparatus consist of:

means 100 for storing a supply of plastic tubular netting N in continuous rope form;

means 200 for expanding such netting in the cross-machine direction;

means 300 for gathering such expanded netting in rucked form;

means 400 for expanding such rucked netting in the machine direction into an elongated sleeve;

means 500 for applying closure members across the expanded sleeve to form a closed end;

means 600 for severing part of the sleeve including such closed end from the remainder of the sleeve to make a bag having an open end;

means 700 for inserting articles into such open end of the bag; and means 800 for closing such open end of the bag to form a package.

These apparatus parts are operatively connected together, in line, thus connected, provide a novel means capable of forming closures and making bags and packages in a continuous, useful, manner.

These, and other, parts of the apparatus will now be described in greater detail.

Netting

The apparatus of this invention in one of its prime aspects makes a bag starting with tubular plastic netting of the type shown in U.S. Pat. No. 2,919,467 to Mercer. Such tubular netting, as made by known techniques, is generally wound onto an appropriate roll or reel in continuous rope form and there stored ready for use. The apparatus of this invention is specifically adapted to take this rope of continuous netting as a starting material and to make a bag and then a package, using such netting.

Rope Storage and Unwind Means

The elements of the means 100 for storing the rope of continuous tubular netting N and the means for unwinding it and moving it to the next work station are best shown in FIGS. 1, 3 and 4. Such netting N in the form of an endless rope is contained in a ball warp 10. The ball warp 10 is shaft mounted and rotates freely on cam follower idlers 11 and 12. The netting is withdrawn from the ball warp 10 by use of rope moving means 13 and is moved to a weigh scale 14 through the nip region formed by a driven V-pulley 15 and a shaped rubber idler 16. The V-pulley is driven by drive motor 17 via its belt drive 18 and associated pulleys. The drive motor 17 is actuated by a limit switch 19 mounted beneath the weigh scale 14 which pivots from a fulcrum point 20. The drive motor 17 operates until the rope moving means 13 deposits a predetermined weight of netting on the weigh scale 14 at which time the motor is deactivated. The limp netting on the weigh scale 14 is then moved, as needed by the apparatus, through guide 21 and into operative relationship with the means 200 for expanding the rope of netting in the cross-machine direction.

Cross-Machine Direction Expanding Means

Figure 2:
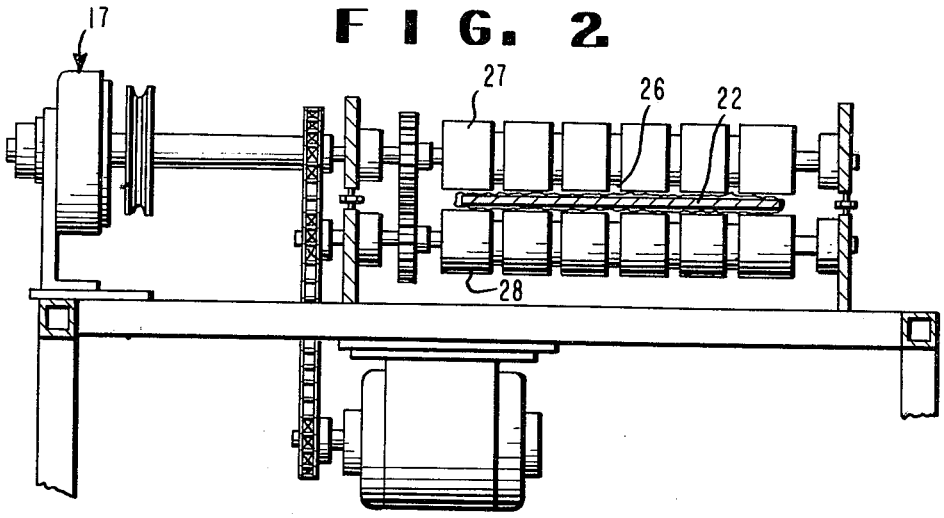
FIG. 2 is a cross-sectional view taken along lines 2—2 of FIG. 1 showing means for gathering the netting in rucked form.
Figure 5:
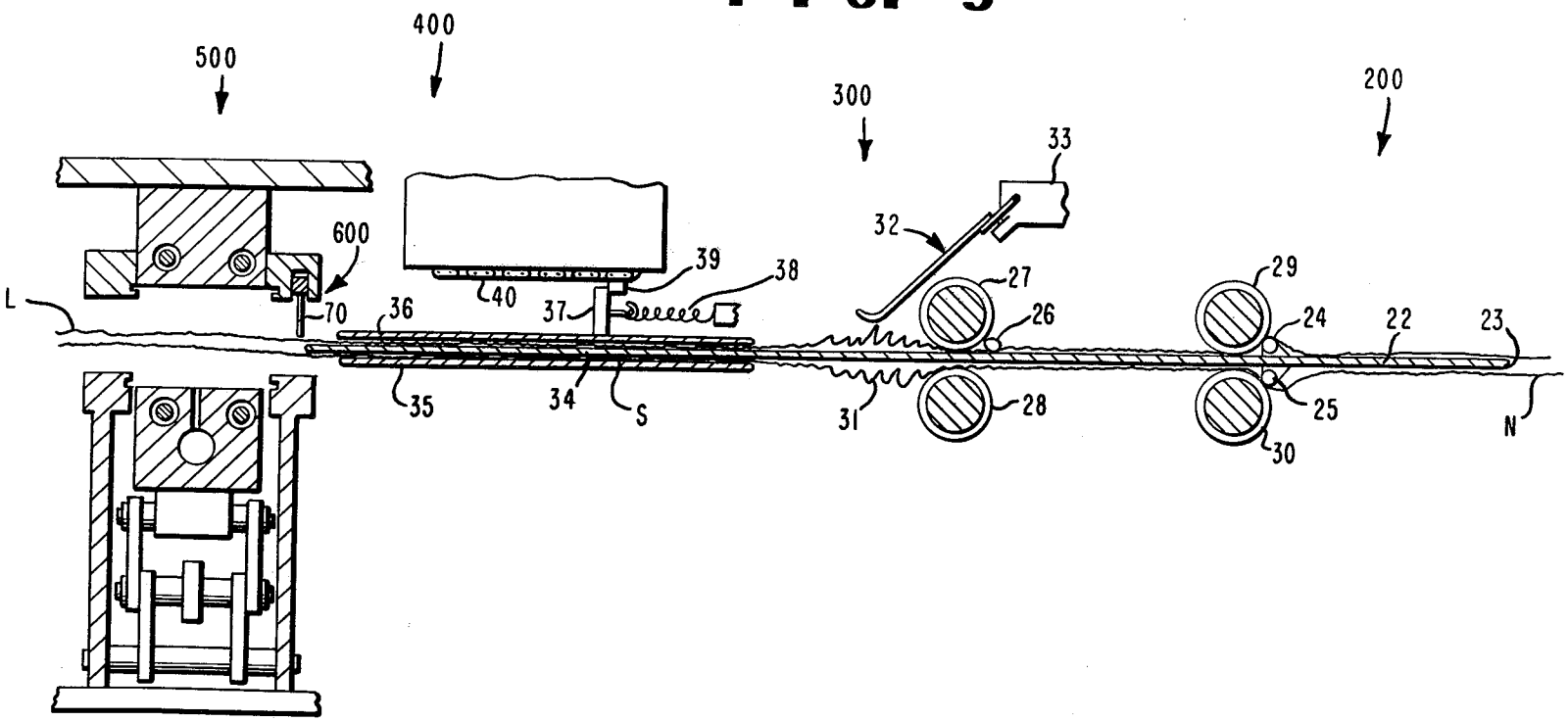
FIG. 5 is a schematic cross-sectional view of parts of such apparatus, taken along lines 5—5 of FIG. 3, including means for expanding tubular netting (from rope form) in the cross-machine direction; means for gathering such expanded netting in rucked form; means for expanding such rucked netting in the machine direction into an elongated sleeve; means for applying closure parts or strips across such elongated sleeve thereby to form a closure; and means for severing such sleeve thereby to make a bag having a closed end and an open end.

The means 200 for expanding the rope of netting N in the cross machine direction is best shown in FIGS. 2, 3, and 5, and generally comprises a netting expander plate 22 having a rounded entrance 23, positioning rollers 24 and 25 and a protruding centering bar 26. Such plate 22 is physically located adjacent and within the nip regions of nip rolls 27, 28 and 29, 30 and is maintained in a substantially horizontal position by the alignment of these nip regions and is held in machine direction alignment by the positioning rollers 24 and 25 and by the protruding centering bar 26 which rides in a centered groove, not shown, in the nip roll 27.

Rucking Means

After the netting N passes over the cross-machine direction expander plate 22 and through the nip rolls 27 and 28 it is gathered in rucked form as shown at 31 by overfeed techniques known to the art using means 300 and including the driven nip rolls 27, 28 and 29, 30. The amount of expanded netting kept in inventory in rucked form is dependent upon the setting of finger 32 of a detector switch 33. The detector switch 33 controls the operation of the drive for such nip rolls. The netting in rucked form 31 is then expanded in the machine direction, by means 400, into an elongated sleeve, designated S, as will now be explained.

Machine Direction Expanding Means

The means 400 for expanding the rucked netting in the machine direction and into an elongated sleeve includes a rearmost portion 34 of the netting expander plate 22 and means for moving such netting in machine direction and over this portion of the expander plate as will be further described hereinafter in connection with the bag-length advancing means. As the rucked netting is moved over this portion of the plate by such advancing means or moving means it forms the elongated sleeve S (the length of which is defined by the rucked netting on one end and the exit of the plate 22 on the other, open end) that is longer than a given bag made using the apparatus of this invention, for reasons further to be explained.

Bag-Length Advancing Means

The bag-length, advancing means, best shown in FIGS. 1, 3 and 5, comprises a lower guide plate 35, an upper guide plate 36, an actuating lug 37, a spring 38, a carrier lug 39 and a stepping drive chain 40. The lower guide plate 35 and the upper guide plate 36 are secured together and operate in unison in the machine direction in tracks, not shown, located toward the sides of the apparatus. The tubular netting is expanded by the plate 22 and is advanced between the lower and upper guide plates 35 and 36 to form the sleeve S. Barbs are located on the leading edges of the two guide plates so that the plates will advance the tubular netting in the machine direction when the plates are moved but will not engage the tubular netting when operating in the reverse direction. The barbs thus will advance the tubular netting in one direction only. This is accomplished when the stepping drive chain 40 is advanced a distance sufficient to advance the open end of the tubular netting beyond the closure applying means 500, as will be explained. In this advanced position of the open end of the tubular netting the upper and lower layers or parts of the collapsed netting are separated from each other since the tubular netting is advanced, in sleeve form, while it surrounds the netting expander plate 22. The upper layer of the collapsed netting is grasped at this time by the bag opening and advancing mechanism so that a bag length L of tubular netting is advanced in preparation for fabrication of a bag.

The advancement of the chain 40 advances the carrier lug 39 which is secured to one of the links of stepping drive chain 40. The carrier lug 39, in turn, advances the actuating lug 37 which is secured to the unified pair of guide plates 35 and 36. The barbs on the advancing guide plates advance the tubular netting material a like distance. When the carrier lug 39 advances the actuating lug 37 as far as it can the spring 38 causes the unified pair of guide plates 35 and 36 to return to their at-rest position in preparation for withdrawing more netting from the netting in rucked form as shown at 31.

It is seen then that the sequence of steps resulting in the forming of the bag-length L of netting and the positioning of it in operative relationship with the closure means whereby a closure may be applied across it includes the following key steps:

- expanding the tubular plastic netting N in continuous rope form in the machine direction;
- gathering such expanded netting in rucked form 31;
- expanding a portion of such rucked netting in the machine direction and into an elongated sleeve S; and,
- moving or advancing a portion, or bag-length L, of this elongated sleeve into operative relationship with the closure applying means 500.

As best seen in FIG. 5 in this position the bag-length L of netting, has an upper or first part and a lower and second part, is collapsed, but open, has its open end beyond the closure station and is advanced beyond and is clear of the plate 22, with its only support coming from the means for moving the netting into this position, not shown in this figure. In this collapsed, open state, with no forces acting on the bag-length portion L except those holding it in this closure applying position such bag-length portion L is ready to be made into a bag, as will now be explained.

Closure Applying Means

Figure 6:
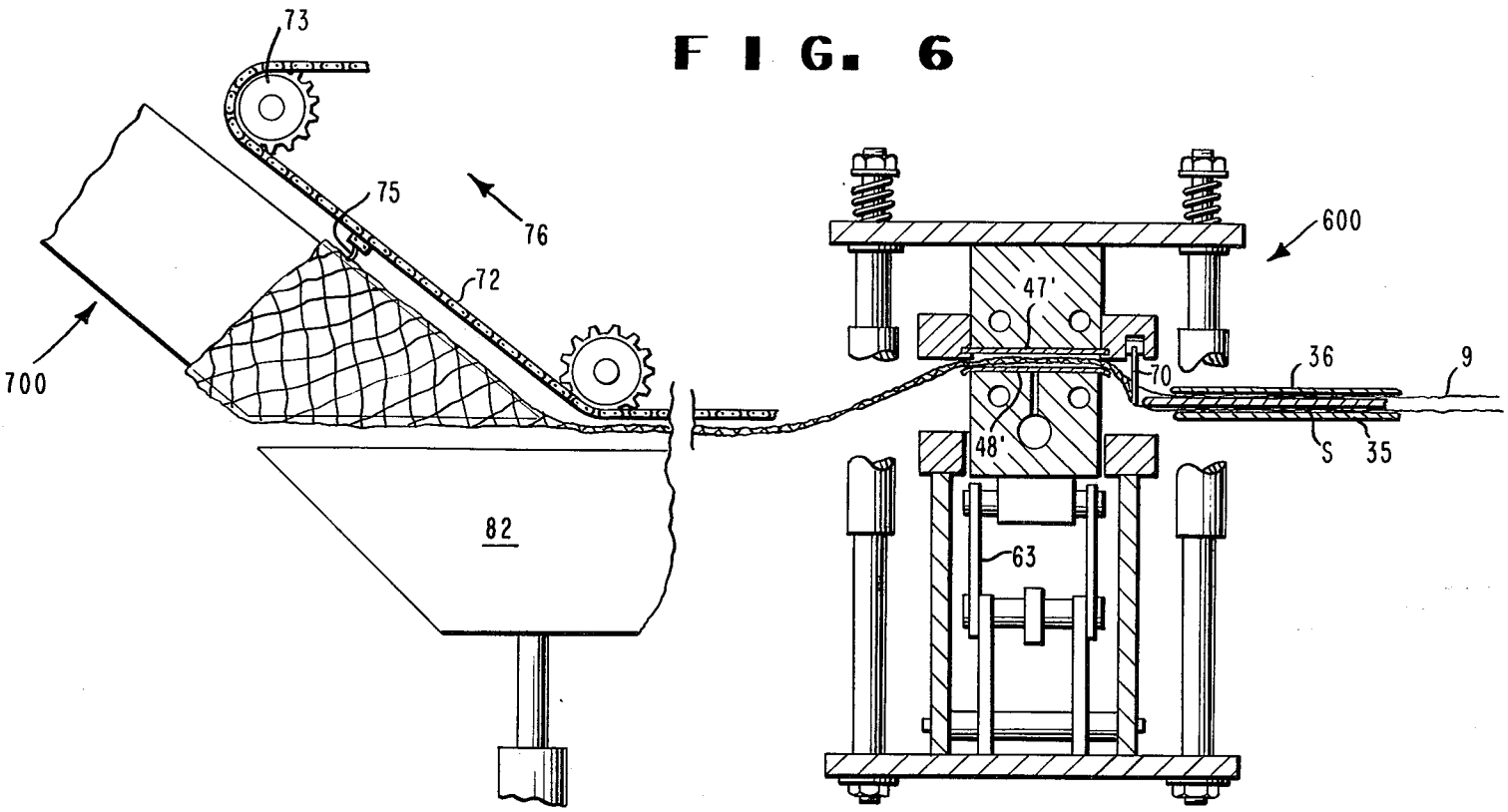
FIG. 6 is a cross-sectional view taken along line 6—6 of FIG. 3, showing the sleeve severing means, the sleeve or bag closure means and means for conveying a bag (made by severing the sleeve after a closure has been applied) toward and to the next-in-line work station of the apparatus.
Figure 7:
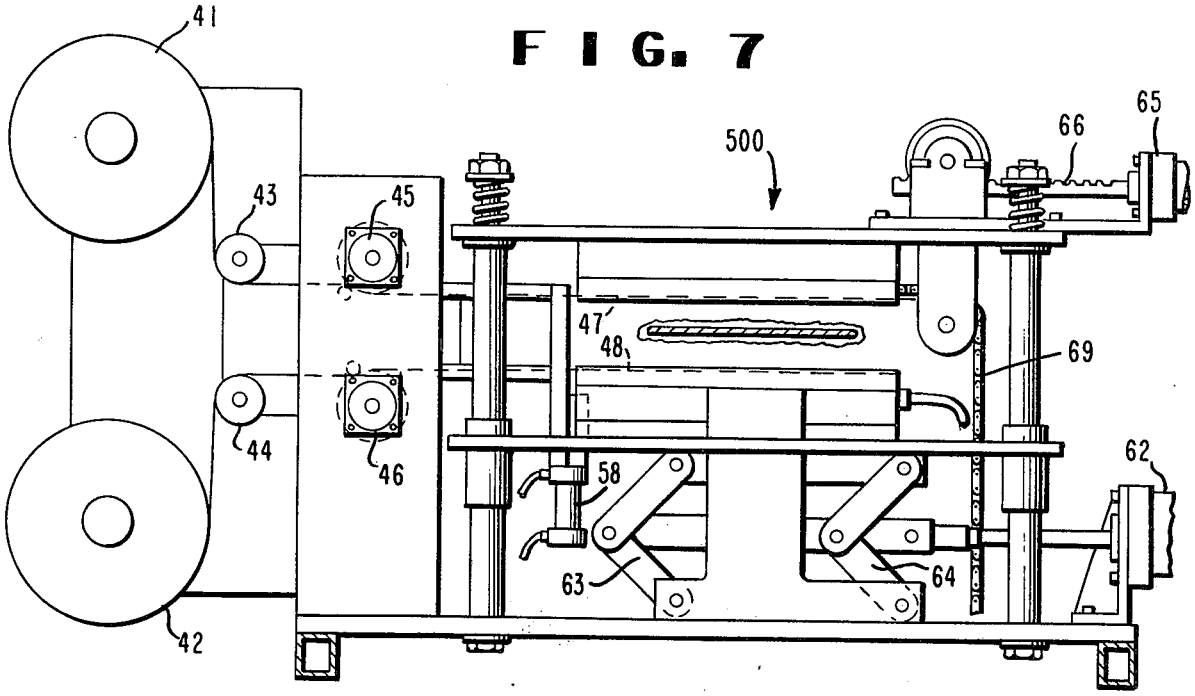
FIG. 7 is a transverse cross-sectional view taken along line 7—7 of FIG. 3, showing, in open position, the means for applying the closure members across the elongated sleeve.
Figure 8:
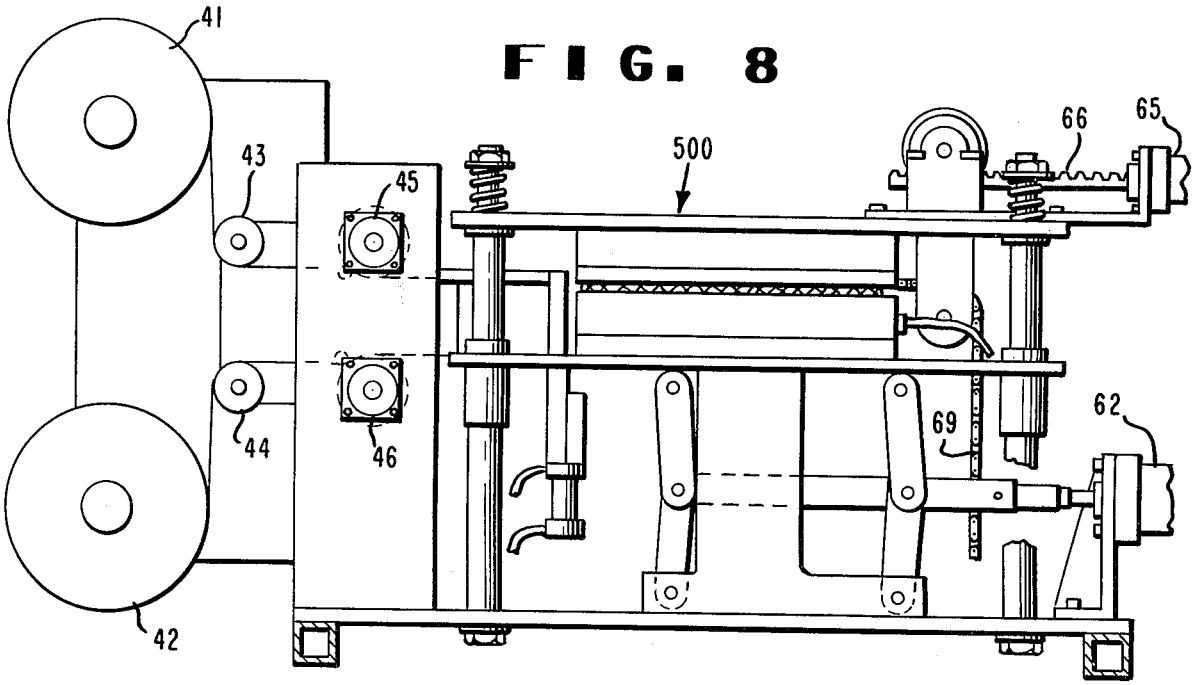
FIG. 8 is a transverse cross-sectional view taken along lines 7—7 of FIG. 3, showing the same closure means, as in FIG. 7, in its closed position.

The means 500 for applying closure members or strips across the bag-length elongated sleeve portion L of netting is best shown in FIGS. 3, 4, 5, 6, 7, 8, 9, 10 and 11. The closure strips supplied to the closure applying means come from two rolls 41 and 42, as shown in FIGS. 7 and 8. The material from these rolls is passed around idler rolls 43 and 44 and then into the closure station of the apparatus by use of indexing rolls 45 and 46. These rolls have peripheral pin projections, not shown, which engage a line of perforations in the tape material so that a definite length of material is measured and moved to the closure station during each operating cycle of the apparatus. The material passes transversely above and below the bag-length L of netting as shown in FIG. 7. The upper and lower material stock 47 and 48 from the rolls 41 and 42 have heat-activatable coatings on their sides that face the netting. The indexing rolls 45 and 46 meter the predetermined lengths of material stock 47 and 48 to the closure applying means via guide slots such as 49 and 50. The lower material stock 48 is held against the surface 51 of the lower platen 52 by vacuum by use of vacuum ports 53 and vacuum channel 54.

Figure 10:
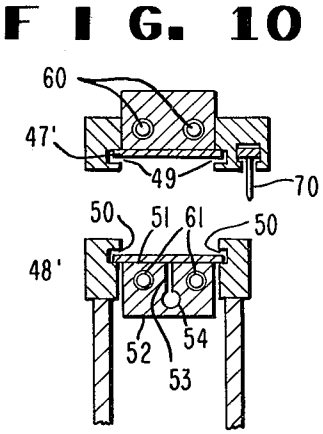
FIG. 10 is a schematic view, taken along lines 10—10 of FIG. 9, showing the vacuum-control guideblocks having the closure strips or members positioned therein.
Figure 9:
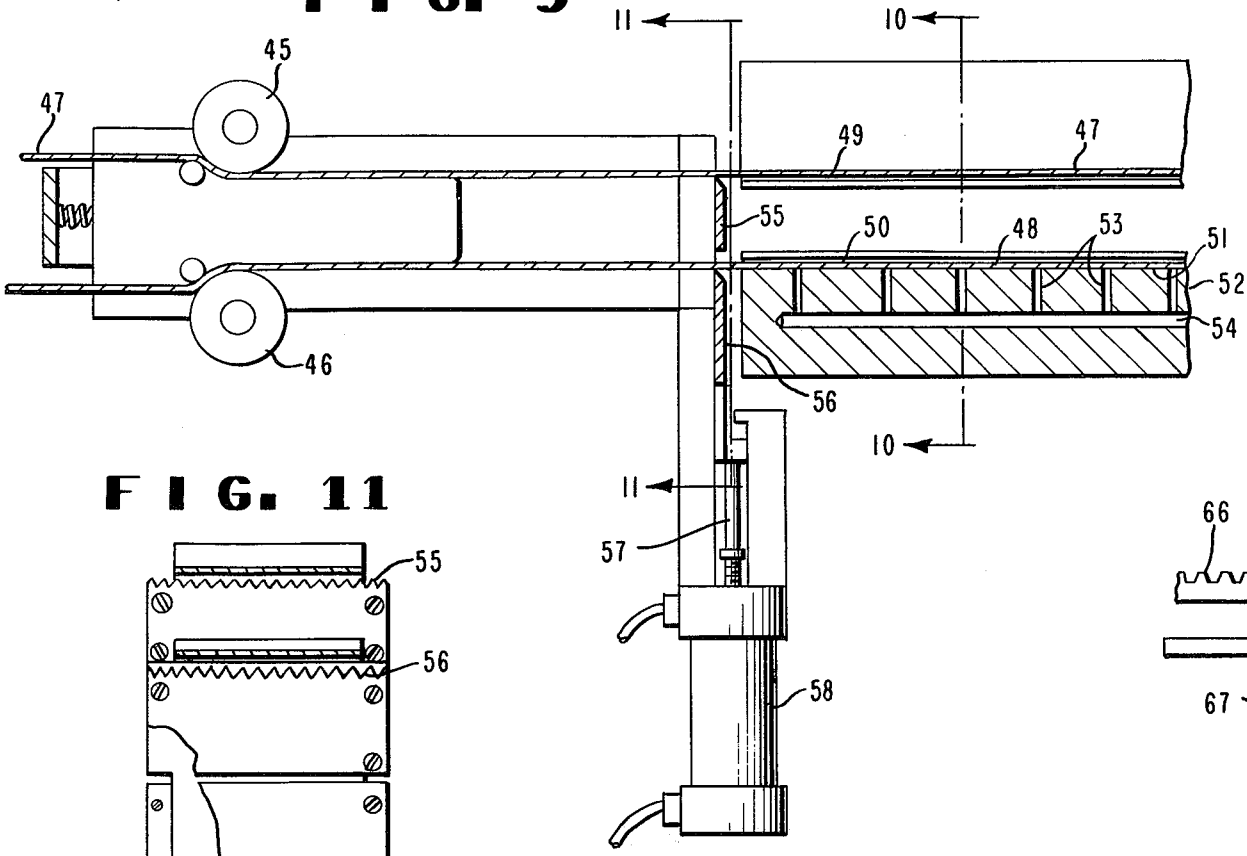
FIG. 9 is a cross-sectional view, taken along lines 9—9 of FIG. 3, showing means for forming the closure strips and for moving such formed strips into vacuum-controlled guideblocks whereat such strips are in position to be applied across the elongated sleeve to form a closure.
Figure 11:
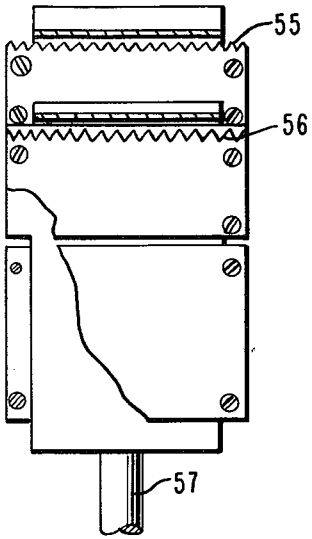
FIG. 11 is a schematic view, taken along lines 11—11 of FIG. 9, showing means for severing the closure strips from their supply source whereby to form such closure strips.
Figure 15:
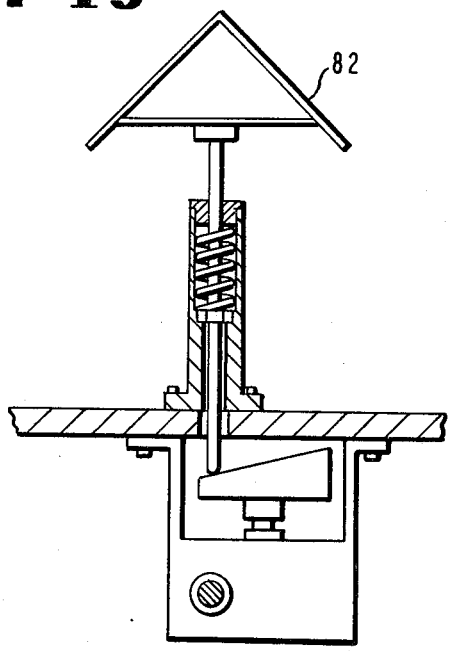
FIG. 15 is a schematic view, taken along lines 15—15 of FIG. 4, showing vertical oscillation means aligning individual bags prior to closing the open end thereof.

The predetermined lengths of the closure material stock are severed, to form closure strips 47' and 48', as shown in FIG. 10, by upper serrated knife 55 and lower serrated knife 56 which are actuated by cylinder rod 57 as shown in FIGS. 9 and 11. The cylinder rod 57 is actuated by pneumatic cylinder 58 which is sequentially timed to actuate after the material stock is transversely advanced across the collapsed tubular netting.

The heat activatable coating on the closure strips 47' and 48' is softened by the heated surfaces of the lower platen 52 and upper platen 59. These platens are heated by the tubular electrical heaters, such as 60 and 61. The heat activated inner surfaces of the closure strips are brought together with the tubular netting between when the closure applying means 500 is actuated so that the lower platen 52 is brought into close proximity with the upper platen 59. The surfaces of these platens never touch because of the presence of the two strips of material stock and the collapsed tubular netting between such platens at the time of forming the closure. The upper and lower strips 47' and 48' are adhered to each other via the interstices of the netting so as to form a transverse closure bonded to and closing the upper and lower parts of the netting. This action forms a bag which has an open end and a closed end spaced from the open end.

Figure 12:
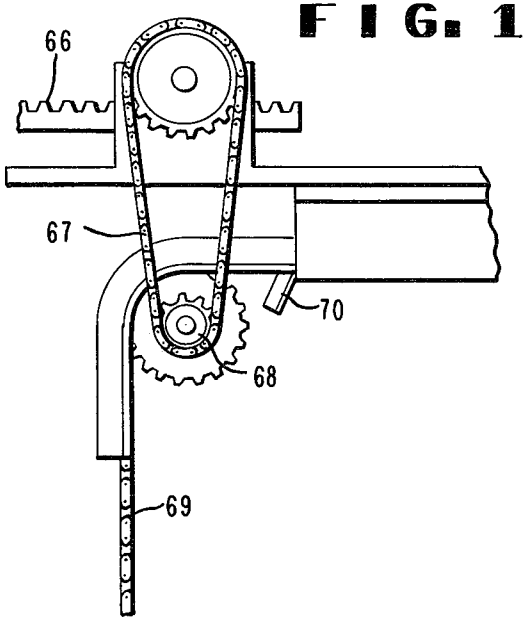
FIG. 12 is a schematic side view of drive means for the sleeve severing means.

The act of moving the lower platen 52 into a cooperative sealing association with the upper platen 59 is brought about by actuating pneumatic cylinder 62 which, in turn, actuates mechanical linkages 63 and 64, all as shown in FIGS. 7 and 8. Immediately subsequent to this action pneumatic cylinder 65 is actuated. The operating piston rod of pneumatic cylinder 65 is connected to rack 66 shown in FIGS. 7, 8 and 12. Rack 66 drives a spur gear, not shown, which actuates chain drive 67. This drive, in turn, operates sprocket 68 that drives chain 69. Flying knife 70 is physically attached to chain 69. This knife traverses the tubular netting adjacent to the newly applied closure strips and severs the newly made bag from the sleeve S. The relative positions of the flying knife 70 and the platens at the beginning of the bag severing sequence are shown in FIG. 6.

Bag Opening and Netting Advancing Means

The bag opening and netting advancing means advances bag-length portions of the tubular netting through the apparatus in sequential operation and presents the formed open-ended bags having a bottom closure so that such bags can be loaded by hand or loaded by use of a separate loading means such as the means 700 for inserting articles into the open end of the bag after which the bag is closed by means 800 to form a package.

Figure 13:
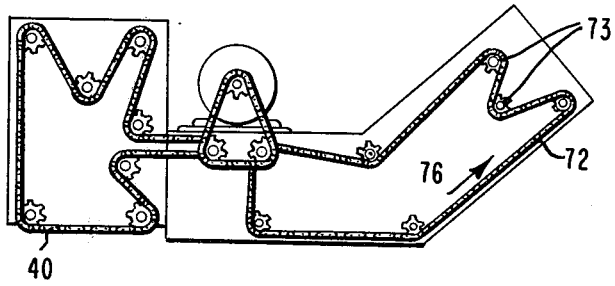
FIG. 13 is a partial schematic elevational view, taken along line 13—13 of FIG. 3, showing the drive mechanism for the means for moving the bag after it is made by the severing operation.
Figure 14:
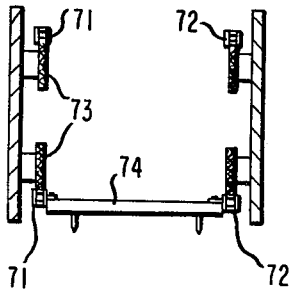
FIG. 14 is a cross-sectional schematic view, taken along lines 14—14 of FIG. 13, showing the configuration of barbs for opening a bag severed from the sleeve and for conveying such bag to the next work station.

Details of the bag opening and netting advancing means are shown in FIGS. 4, 6, 13, and 14. As best shown in FIGS. 13 and 14 this means mainly comprises parallel chains 71 and 72, sprockets such as 73, crossbar 74 and crossbar barbs 75. The crossbar 74 is physically attached to opposing links of chains 71 and 72 and is driven by these chains in synchronism with the operation of the bag-length feed means, the closure applying means 500 and the sleeve severing means 600.

The drive is timed so that the barbs 75 are positioned to engage the upper layer of the tubular netting when such netting is advanced beyond the position of the closure applying means by the bag-length feed means. After the engagement of the barbs with the open end of the tubular netting the netting is advanced one bag length by exerting a pulling force on the upper layer of the netting only so as to keep the open end of such netting in an opened configuration. The ending of this cycle occurs when the open end is along a path such as 76 shown in FIGS. 4 and 13. After the ending of the cycle the previously-described closure applying and severing operations occur so that a netting bag is formed with an open end held in position for insertion of an article in a filling operation.

The Package Forming Means

The package forming means of the apparatus of this invention comprises the article inserting means 700 and the bag closing means 800. These are best shown in FIGS. 1, 3, 4, 6, 15 and 16.

Figure 16:
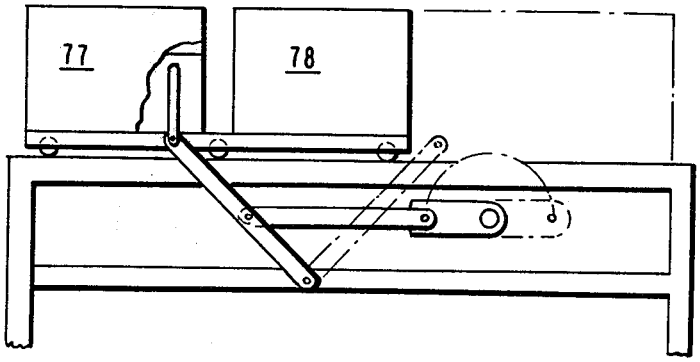
FIG. 16 shows means for laterally displacing the bag expanding units during successive apparatus cycles, taken along line 16—16 of FIG. 4.

The article inserting means 700 can be most any type of conventional weigh-and-feed system that transfers weighed or metered product into a tube, or chute, from a source of supply. Illustrated in the cited figures is a dual chute system having a first discharge chute 77 and a second discharge chute 78. Each chute has a pair of bag-expanding fingers such as operating bag expanding finger 79 and fixed bag expanding finger 80. Each discharge chute is transversely operable from a position along the centerline of the netting bag to its own respective side of the apparatus as shown in FIG. 3 and FIG. 16. FIGS. 4 and 16 show a simple linkage used to transversely move each chute from its centerline position to the position wherein it transfers the loaded bag to an exit conveyor such as 81. When the chute is in its centerline position its operating bag expanding finger closes as shown in FIG. 3 permitting the bag opening and advancing means to advance the bag around and up the chute. At this time the operating bag expanding finger opens and product is discharged from a weighing or metering device into the chute opening and down the chute into the netting bag. Vibrating guide 82, shown in FIGS. 4 and 6, assists in loading the product into the tubular netting bag by vertically oscillating the bag as it is loaded via the discharge chute.

The loaded bag is then transferred to the bag closing means 800, such as a stapling machine, band crimping machine or plastic closure applying machine as shown in FIGS. 3 and 4. The completed packages are then removed from the apparatus by package conveyor 83.

Operation

In brief review, the apparatus of this invention is capable of forming a closure for a bag made from plastic netting N in continuous rope form unwound from a reel, in a continuous repetitive manner, in an improved manner including the steps of:

- expanding such netting N into elongated sleeve S with an open end, and
- applying a flat elongated strip across such sleeve S thereby forming a closure for such bag.

Such apparatus is further capable of:

- expanding such netting N in the cross-machine direction;
- gathering such expanded netting in rucked form 31;
- expanding a portion of such rucked netting in the machine direction into the elongated sleeve S; and
- applying closure members across such sleeve thereby forming a closure for such bag.

The closure members are adhered together through open meshes of such netting N.

The apparatus further is capable of

- expanding the tubular plastic netting N in continuous rope form into an elongated sleeve S with an open end;
- positioning a first bottom closure strip 48' across a first part of such sleeve S;
- positioning a second bottom closure strip 47' across a second part of such sleeve S and aligned with such first strip 47';
- one of such strips having an adhesive coating on its inner surface and such strips being arranged to extend substantially from one edge of such sleeve to the other edge; and,
- adhering such first and second strips 47 and 48' together through open meshes of such netting thereby to form a bag having a closed end and an open end.

And, such apparatus is capable of

- severing such sleeve adjacent such bottom closure to such bag;
- inserting articles into such open end of such bag; and
- closing such open end of such bag to form a package.

And, lastly, in making bags according to and using the apparatus this invention it is particularly important that the tubular netting N in rope form be expanded in the cross-machine direction, then rucked to form a supply of rucked netting 31 on which no machine direction forces act, prior to expanding a portion of this rucked netting in the machine direction whereby to position it to proper relationship to the closure means 500 which then is actuated to apply the closure strips 47' and 48' to and across the thus expanded netting to form the closure. Since only a portion of the rucked netting is expanded in the machine direction, still leaving other portions of the rucked netting at the supply area, there are no problem forces, particularly machine direction or tension forces, acting on such expanded portion of the netting during the application of the closure strips.

I claim:

1. In a method of forming in-line on a package-making machine a closure for a package using tubular plastic open-mesh netting in continuous rope form unwound from a reel, in a continuous repetitive manner, an improvement including the steps of:

- expanding such netting in the cross-machine direction;
- gathering such expanded netting in rucked form;
- expanding a portion of such rucked netting in the machine direction and into an elongated sleeve;
- moving a portion of this elongated sleeve while maintained in the expanded state into operative relationship with a closure applying means; and
- applying a closure across such portion of this expanded sleeve while holding such portion of the sleeve in such operative relationship with such closure applying means, thereby forming a closure for such package.

2. In a method of making a package continuously and in-line on a package-making machine, an improvement including the steps of:

- moving, in an intermittent manner, determined lengths of tubular thermoplastic open-mesh netting from a ball warp to a spreading device;
- spreading the netting as it is moved from the ball warp by internal means;
- rucking a supply of the spread-open netting around a mandrel;

moving, on demand, sufficient netting, while maintained in the spread-open state, from and connected to the supply of rucked netting to make the package; and applying a closure across the netting while holding it in its spread-open state thereby forming a closure for the package.

3. An apparatus for use in continuously packaging in-line a product in tubular thermoplastic netting comprising:

an unwind mechanism for holding a supply of continuous-length tubular netting in rope form on a ball warp, means for moving the netting from the unwind mechanism around an internal expanding device and onto a part thereof for storing the netting in rucked form;

said expanding device and said unwind mechanism being located in-line on the apparatus, means for expanding the rucked netting in the machine direction and for intermittently moving such expanded netting, while maintained in the expanded state, to a bag forming mechanism having means for applying a label across the thus expanded netting at bag length intervals and means to sever the bag length of netting having a label from the remainder of the continuous-length thermoplastic netting to form a bag closed at one end by the label and open at the opposite end.

4. An apparatus for making a package using tubular open-mesh plastic netting comprising, in combination, in-line and operably connected together:

means for storing a supply of such netting in continuous rope form;

means for expanding such netting in the cross-machine direction;

means for gathering such expanded netting in rucked form;

means for a moving portion of such rucked netting in the machine direction and maintaining it as an expanded sleeve having substantially flat first and second sleeve parts, one atop the other;

means for positioning a first strip across such expanded sleeve and adjacent to the outer surface of such first sleeve part;

means for positioning a second strip across such expanded sleeve and adjacent to the outer surface of such second sleeve part and aligned with the first strip;

at least one of such strips having an adhesive coating on its inner surface and such strips being positioned to extend substantially from one edge of such elongated sleeve to the other edge;

means for adhering such first and second strips together through the open meshes of such expanded sleeve while holding it in its expanded state thereby to form a bottom closure for such package;

means for severing such sleeve to make a bag having a bottom closure, expanded first and second sleeve parts, and an open end;

means for inserting articles into such open end of such bag; and means for closing such open end of such bag to form the package.

5. An apparatus for making a package using open-mesh plastic netting in continuous rope form including in combination and in-line:

means for expanding such netting in the cross-machine direction;

means for gathering such expanded netting in rucked form;

means for expanding a portion of such rucked netting in the machine direction and into an elongated sleeve having an open end and substantially flat first and second sleeve parts, one atop the other;

means for moving a portion of this elongated sleeve while maintained in the expanded state into operative relationship with a closure applying means;

means for holding such portion of the expanded sleeve in such operative relationship with such closure applying means;

means for positioning a first strip across such portion of the sleeve and adjacent to the outer surface of such first sleeve part;

means for positioning a second strip across such portion of the sleeve and adjacent to the outer surface of such second sleeve part and aligned with the first strip;

at least one of such strips having an adhesive coating on its inner surface and such strips positioned to extend substantially from one edge of such sleeve to the other edge;

means for adhering such first and second strips together through the open meshes of such portion of the sleeve while such portion of such expanded sleeve is held in such operative relationship with such closure means thereby to form a bottom closure for such package;

means for severing such sleeve adjacent such bottom closure to make a bag;

means for inserting articles into such open end of such bag; and means for closing such open end of such bag to form the package.

* * * * *